US007210659B2

(12) United States Patent
Lawson et al.

(10) Patent No.: US 7,210,659 B2
(45) Date of Patent: May 1, 2007

(54) COMBINATION OF TELESCOPICALLY EXTENDABLE FRAME WITH A LAUNDRY BAG ASSEMBLY

(76) Inventors: Stephen Lawson, 1947 Ocean Park Road, Surrey, B.C. (CA) V4A 3M2; Christopher Isfeld, 30681 Regal Parkway, Abottsford, B.C. (CA) V3G 1L1

( * ) Notice: Subject to any disclaimer, the term of this patent is extended or adjusted under 35 U.S.C. 154(b) by 0 days.

(21) Appl. No.: 11/032,614

(22) Filed: Jan. 11, 2005

(65) Prior Publication Data

US 2006/0255213 A1 Nov. 16, 2006

(51) Int. Cl.
*B65B 67/12* (2006.01)
*A47F 5/08* (2006.01)

(52) U.S. Cl. ..... 248/95; 211/94.01; 211/94.02; 211/46

(58) Field of Classification Search ..... 211/1.53, 211/10, 11, 12, 42, 46, 94.01, 94.02, 126.15, 211/126.13, 105.1, 186; 248/99, 95, 100; 312/212, 183, 184, 334.11
See application file for complete search history.

(56) References Cited

U.S. PATENT DOCUMENTS

| | | | | | |
|---|---|---|---|---|---|
| 2,087,149 | A * | 7/1937 | Hendrix | 211/162 |
| 2,468,897 | A * | 5/1949 | Rothe | 383/22 |
| 3,556,395 | A * | 1/1971 | Herman | 232/43.2 |
| 4,588,154 | A * | 5/1986 | Basore | 248/99 |
| 4,979,705 | A * | 12/1990 | Bovitz | 248/97 |
| 5,294,009 | A | 3/1994 | Maurer et al. | |
| 5,380,081 | A * | 1/1995 | Vogt | 312/212 |
| 5,540,501 | A | 7/1996 | Franco | |
| 5,667,066 | A * | 9/1997 | Simpson | 206/278 |
| D393,512 | S * | 4/1998 | Van de Oudeweetering | D34/21 |
| D404,861 | S * | 1/1999 | Balensiefer, II | D32/37 |
| 5,873,642 | A * | 2/1999 | Domenig | 312/183 |
| 6,224,259 | B1 | 5/2001 | Guerra | |
| 6,398,410 | B1 | 6/2002 | Guerra | |
| 6,679,392 | B1 * | 1/2004 | Costa | 211/94.01 |
| 6,824,232 | B2 * | 11/2004 | Farmer | 312/293.2 |
| 6,935,519 | B2 * | 8/2005 | Lawson et al. | 211/94.02 |
| 2003/0071001 | A1 * | 4/2003 | Goldberg | 211/123 |

* cited by examiner

*Primary Examiner*—Carl D. Friedman
*Assistant Examiner*—Tan Le
(74) *Attorney, Agent, or Firm*—Frederick Kaufman

(57) ABSTRACT

The invention is directed to a combination of a telescopically extendable frame with a laundry bag assembly, adaptable to be mounted in closet receptacles of various articles of furniture. The combination comprises a telescopically extendable frame incorporating front and back support bars and a laundry bag assembly including one or more laundry bags interengaged with the front and back support bars and hanging below them. The one or more laundry bags can be translatable with respect to the front and back support bars. The front and back support bars are so spaced apart as to permit the laundry bag assembly to be located between and suspended from them. The telescopically extendable frame comprises left and right slides of ball bearing drawer type slides.

4 Claims, 4 Drawing Sheets

COMBINATION OF TELESCOPICALLY EXTENDABLE FRAME WITH A LAUNDRY BAG ASSEMBLY

I. BACKGROUND OF THE INVENTION

1. Field of the Invention

The present invention relates in general to household storage of laundry bags. More specifically, it relates to a combination of a telescopically extendable frame with a laundry bag assembly.

2. Description of the Prior Art

Generally, laundry bags have been used to store soiled and dirty clothing until it is washed and dried. This clothing, which needs laundering, generally falls into the following categories: clothes (garments), bedclothes such as sheets and pillow cases, and those items used in personal cleanliness, such as towels and washcloths. The items to be laundered are not always immediately laundered, and need to be stored until the laundering thereof. In addition, while all of the items to be laundered are made of fabric, there are different kinds of fabric and, for maximum life of laundered items and optimum quality of laundering; they require different pre-established laundering cycles.

Different combinations of laundry bags with various types of stands have been made and used. For example, U.S. Pat. No. 5,967,342 granted on Oct. 19, 1999 to Steffine for a "MULTIPURPOSE LAUNDRY CART" describes a cart provided with a frame that supports laundry bags therein. The frame is provided with a top having an upwardly open mouth and a bottom having caster wheels for mobility of the frame. Three laundry bags are suspended in the frame from the mouth. As can be learned from the disclosure and can be seen in the drawings, no means for an easy detachment of the laundry bags from the frame is provided and no means for grasping and carrying the laundry bags is used.

U.S. Pat. No. 4,979,705 granted on Dec. 25, 1990 to Bovitz for a "LAUNDRY BAGS AND FRAME APPARATUS" discloses a demountable frame apparatus having front and back support rails thereon and a plurality of laundry bags, each having an open top, closed bottom and continuous sidewalls. The sidewalls have support loops adjacent the open mouth. Two rods support each laundry bag, with a rod going through each support loop. The rods engage upon the support rails and can slide along the length of the latter. The main disadvantage of the structure of this apparatus resides in the fact that it is stationary and therefore cumbersome in a household environment. There are known also a "ROLLING CHROME 3 BAG LAUNDRY HAMPER BIN", incorporating a rigid frame cart on casters, and a "FOLDING CHROME LAUNDRY BIN WITH A CANVAS BAG" that includes a scissor type folding structure, both sold by RILLO HOME. In addition, a "NEW HAILO LAUNDRY SORTER HAMPER 3 BAGS WITH QUICK GRAB" is sold by HAILO.

II. SUMMARY OF THE INVENTION

Without question, the field of laundry bags and of the stands thereof is very active and the inventors of the present combination realized that the need for an improved combination between the former and the latter is real and very pressing. The inventors believe that one of the outstanding problems in the field of laundry bags resides in the difficulty of keeping them and their stands in closets, out of sight.

Thus, it is a first objective of the present invention to judiciously use the confined spaces, available in closet receptacles, to keep the laundry bags and their stands out of sight in a functional and stylish manner.

It is another objective of this invention to provide a system that conveniently, compactly and economically provides a sorting of items to be laundered, compact storage thereof, and easy removal and transport of laundry bags containing sorted items to the washing machine.

It is still another objective of the present invention to provide an extendable frame adaptable for use in conjunction with closet receptacles of different widths.

It is a further objective of this invention to use, for the extendable frames, ball bearing drawer slides, which are extensively tested, and mass-produced in different sizes Broadly stating, the present invention is directed to a combination of a telescopically extendable frame with a laundry bag assembly, adaptable to be mounted in closet receptacles of various articles of furniture. The combination comprises a telescopically extendable frame incorporating front and back support bars and a laundry bag assembly including one or more laundry bags inter-engageable with the front and back support bars and hanging below them. Thus, the one or more laundry bags can be translatable with respect to the front and back support bars. The front and back support bars are so spaced apart as to permit the laundry bag assembly to be located between and suspended from them.

The telescopically extendable frame comprises left and right slides of ball bearing drawer type slides and also the front and back support bars, each one of the left and right slides including external and internal rails and a multiplicity of antifriction rolling elements disposed between them. Each external rail is adaptable to be secured to an adjacent panel facing an interior of the closet receptacle of an article of furniture. The front and back support bars are each attached with their extremities to the internal rails. Each one of the one or more laundry bags includes, when collapsed, a pair of flat overlying panels adapted to form a pair of opposite panels and a pair of folded panels, generally extendable inwardly between the pair of opposite panels from opposite side edges of the latter and adapted to form a pair of opposite side panels. Each one of the one or more laundry bags, seen when unfolded, has a closed, flat bottom. Each one of the pair of opposite panels and an adjacent one of the pair of opposite side panels are connected together, along their side edges. Each one of the pair of opposite panels is provided adjacent its top with a pair of spaced suspension loops, each one of the latter being equally spaced from a proximate upper intersection between one of the pair of opposite panels and an adjacent one of the pair of opposite side panels.

The laundry bag assembly includes as well a pair of hangers for each one of the one or more laundry bags. Each one of the pair of hangers, having a rod structure with a generally elongated profile, is provided with a central grip portion, adaptable to accommodate a user's hand. The central grip portion is spaced upwardly from a remainder part of each one of the pair of hangers and being situated above the latter (remainder part), prevents an interfering with the pair of suspension loops. The central grip portion being vertically oriented, the carrying of each one of the one or more laundry bags can be comfortably accomplished in one hand. Each one of said pair of hangers terminates at each end with a semi-circular configuration that is so dimensioned as to engage upon and slidably fit on the front and back support bars. The semi-circular configurations expand upwardly from the remainder part of each one of the pair of hangers, comparatively less than the central grip portion. Each one of the pair of hangers can be easily inserted through the pair of spaced suspension loops of each one of the pair of opposite panels. Thus, the central grip portion will be always situated between the pair of spaced suspension loops, while the removal of each one of the pair of hangers from the latter is, obviously, as easy as the insertion into them.

In one aspect of this invention, the combination of a telescopically extendable frame with a laundry bag assembly uses front and back support bars that are each permanently attached with their extremities to the internal rails of the left and right slides.

In another aspect of this invention, the combination of a telescopically extendable frame with a laundry bag assembly uses front and back support bars that are each non-permanently attached with their extremities to the internal rails of the left and right slides, whereby use can be made of different lengths for the front and back support bars for compatibility with different widths of the closet receptacles.

In yet another aspect of this invention, the combination of a telescopically extendable frame with a laundry bag assembly further comprises a pair of elongated bodies. One of the pair of elongated bodies is used for longitudinally locating the left slide, while the other one of the pair of elongated bodies is used for longitudinally locating the right slide. Each one of the pair of elongated bodies incorporates transversally, almost entirely, either one of the left and right slides, the pair of elongated bodies being perpendicularly traversed by a pair of extremities of the front and a back support bars.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

IV. DESCRIPTION OF THE PREFERRED EMBODIMENTS

It is to be agreed, that terms, such as "top", "bottom", "left", "right", "vertical" and "horizontal" are conventionally used in the present description with reference to the normal position in which a telescopically extendable frame and one or more laundry bags supported by the telescopically extendable frame would be used.

Figure 1:
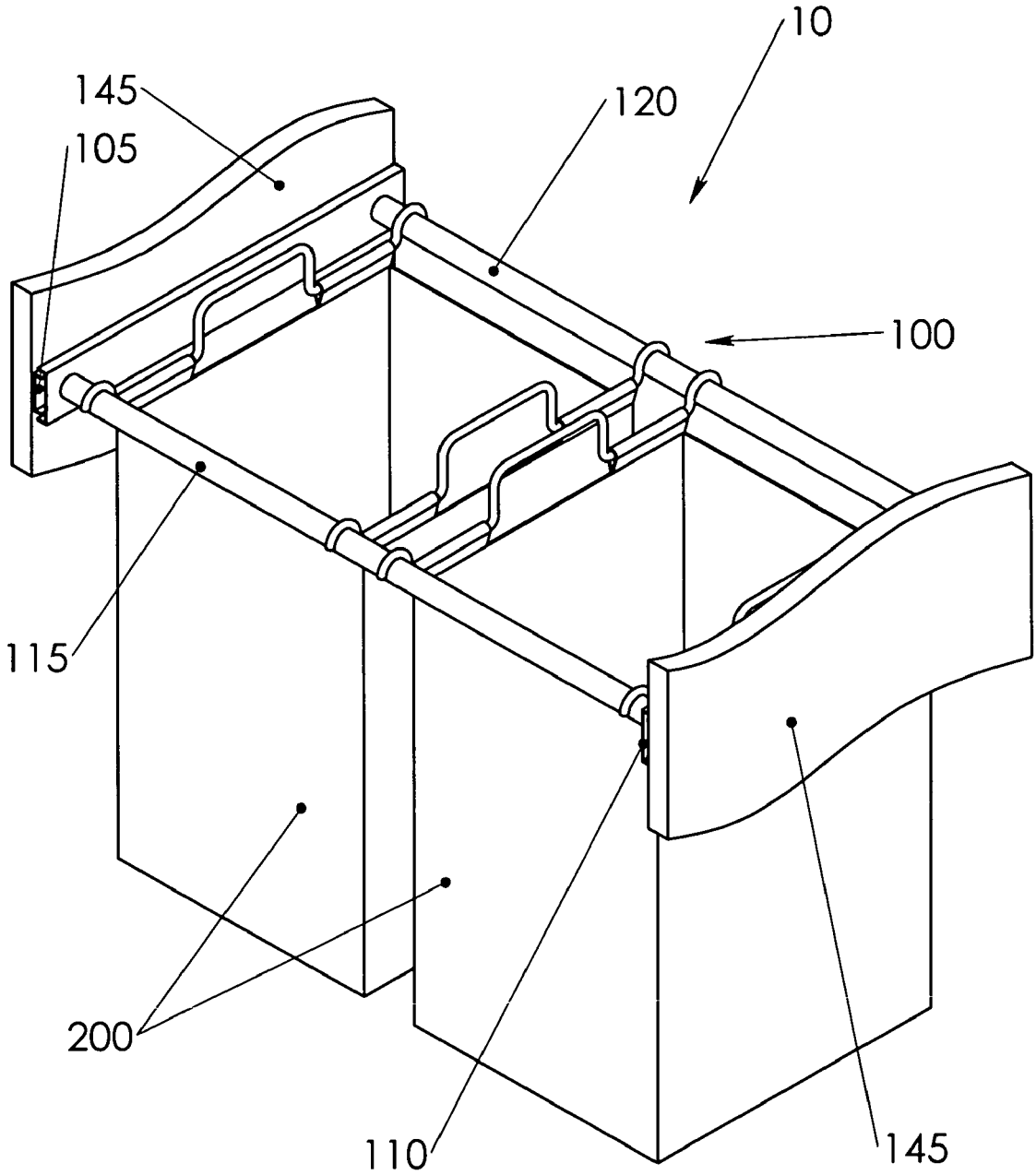
FIG. 1 is a perspective view of the combination assembled to a pair of panels of an interior of a closet.
Figure 2:
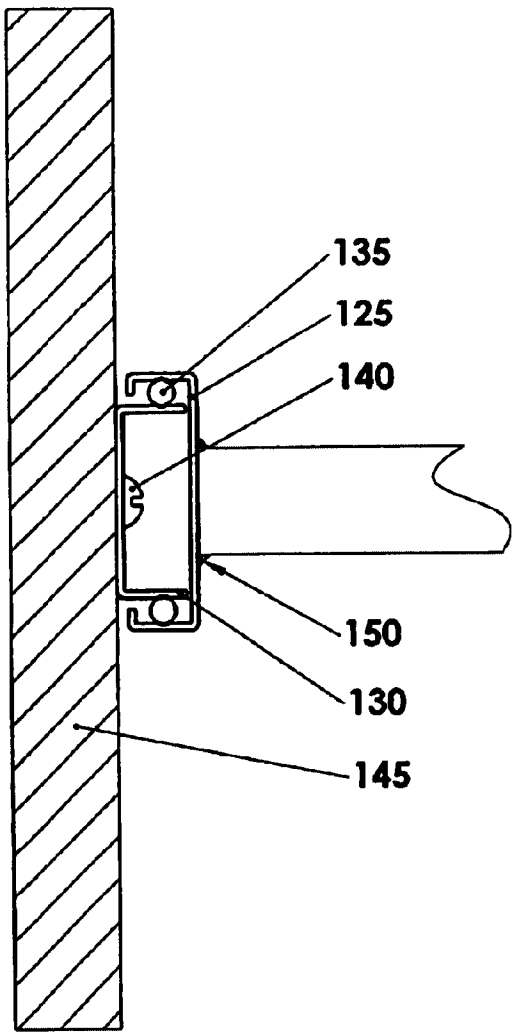
FIG. 2 is a longitudinal sectional view of a front or back support bar, continued with successive transversal sectional views of a left slide and a panel, to which panel an internal rail is attached (in this figure the front or the back support bar is permanently secured by welding to an external rail)

The combination of a telescopically extendable frame with a laundry bag assembly of this invention is generally indicated at 10 in FIG. 1, wherein a telescopically extendable frame is generally indicated at 100 and a laundry bag assembly is generally indicated at 200. Telescopically extendable frame 100 comprises left and right slides 105 and 110 and front and back support bars 115 and 120. Left and right slides 105 and 110 are each incorporating external and internal rails 125 and 130 (see FIG. 2) and a multiplicity of antifriction rolling elements 135 disposed between those rails. External rail 125 being larger than internal rail 130 transversally incorporates at least part of the latter. Left and right slides 105 and 110 are of ball bearing drawer slides type and are sold under the name Accuride™ by Accuride, Santa Fe Springs, Calif. There are as well other companies supplying the market with similar type of slides.

Figure 3:
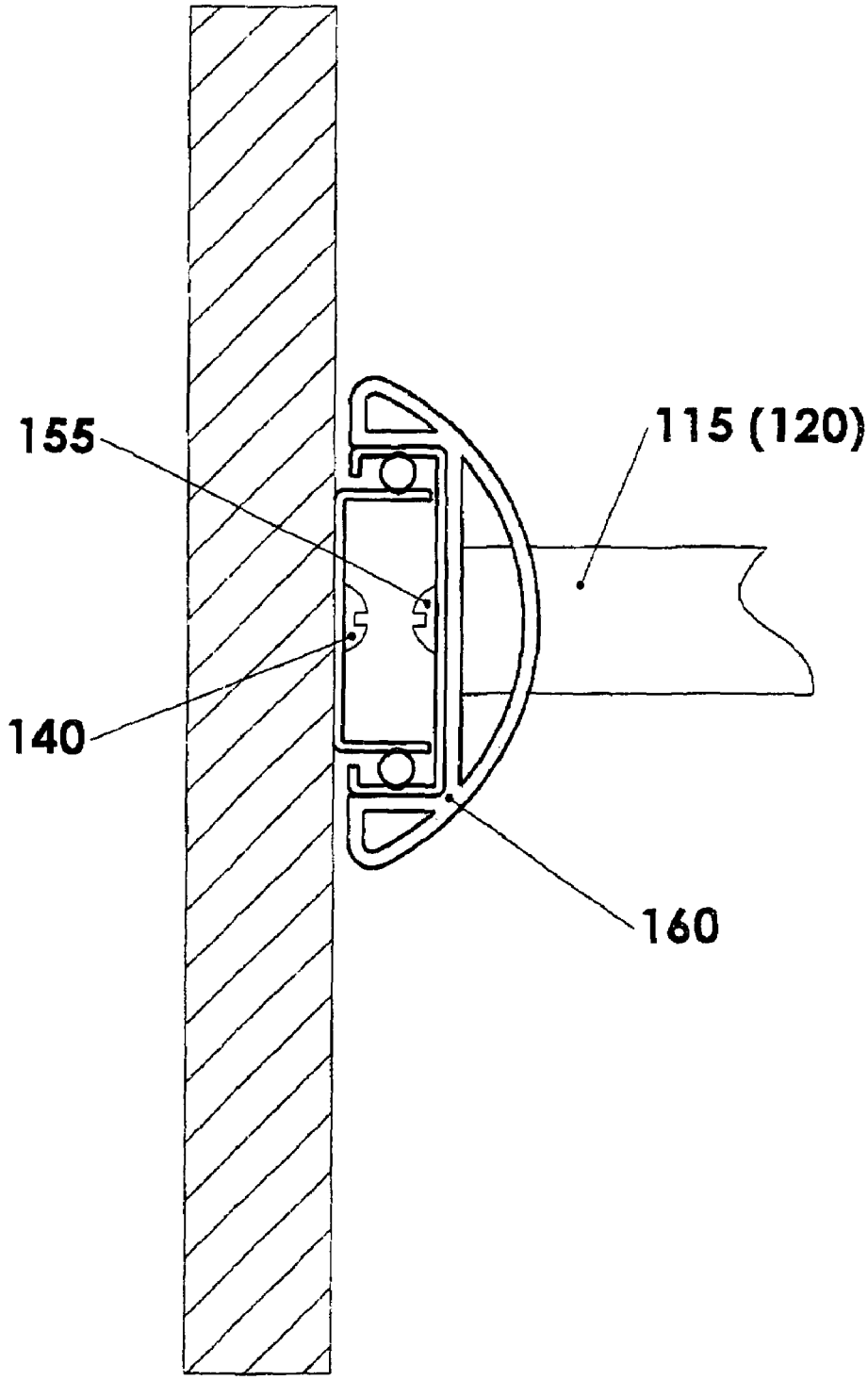
FIG. 3 is a longitudinal sectional view of a front or back support bar, continued with successive transversal sectional views of an elongated body, wherein a left slide is located, and a panel, to which panel an internal rail is attached (in this figure the front or the back support bar is secured non-permanently with screws to an external rail)

Each internal rail 130 is adaptable to be secured by fasteners 140 (usually screws) to an adjacent panel 145 facing an interior of an article of furniture (not shown). Generally, front and back support bars 115 and 120 are each attachable with their extremities either to internal or external rails 130 and 125, respectively. If front and back support bars 115 and 120 are attached to external rail 125, internal rails 130 is attached to panel 145 and, conversely, if front and back support bars 115 and 120 are attached to internal rail 125, external rail 125 is attached to panel 145. The attachment can be permanent by welding 150 (see FIG. 2), or non-permanent by tapping screws 155 (see FIG. 3). In the latter attachment, front and back support bars 115 and 120 are each provided with a retaining internal channel of relatively small diameter (not shown) for inserting tapping screws 155. The non-permanent attachment allows the use of front and back support bars 115 and 120 of different lengths in conjunction with closet receptacles of different widths.

In another embodiment of the present invention, use is made of a pair of elongated bodies 160 (refer back to FIG. 3), one elongated body 160 for longitudinally locating left slide 105 and the other elongated body 160 for longitudinally locating right slide 110. Transversally, each elongated body 160 incorporates, almost entirely, a left or a right slide, respectively 105 or 110. The former and the latter are perpendicularly traversed by a pair of extremities of a front and a back support bar 115 or 120, respectively.

Front and back support bars 115 and 120 are so spaced apart as to permit laundry bag assembly 200 to be located between them and suspended from them.

Laundry bag assembly 200 comprises one or more laundry bags 205 and a pair of grip and carry hangers, further called hangers 230, for each laundry bag 205. When more laundry bags 205 are used, this allows a sorting of the laundry to be washed, according to the type and color of the fabric.

Laundry bag 205 is made of washable fabric (conveniently to be washed together with the laundry) and includes, when collapsed, a pair of flat panels, forming a pair of opposite panels 210 and a pair of folded panels, generally extendable inwardly between the pair of opposite panels 210 from opposite side edges of the latter and forming a pair of opposite side panels 215. Laundry bag 205, seen when unfolded, has a closed, flat bottom 220, usually formed from a single piece of fabric that is peripherally attached to lower ends of each pair of opposite and opposite side panels 210 and 215 respectively.

Figure 4:
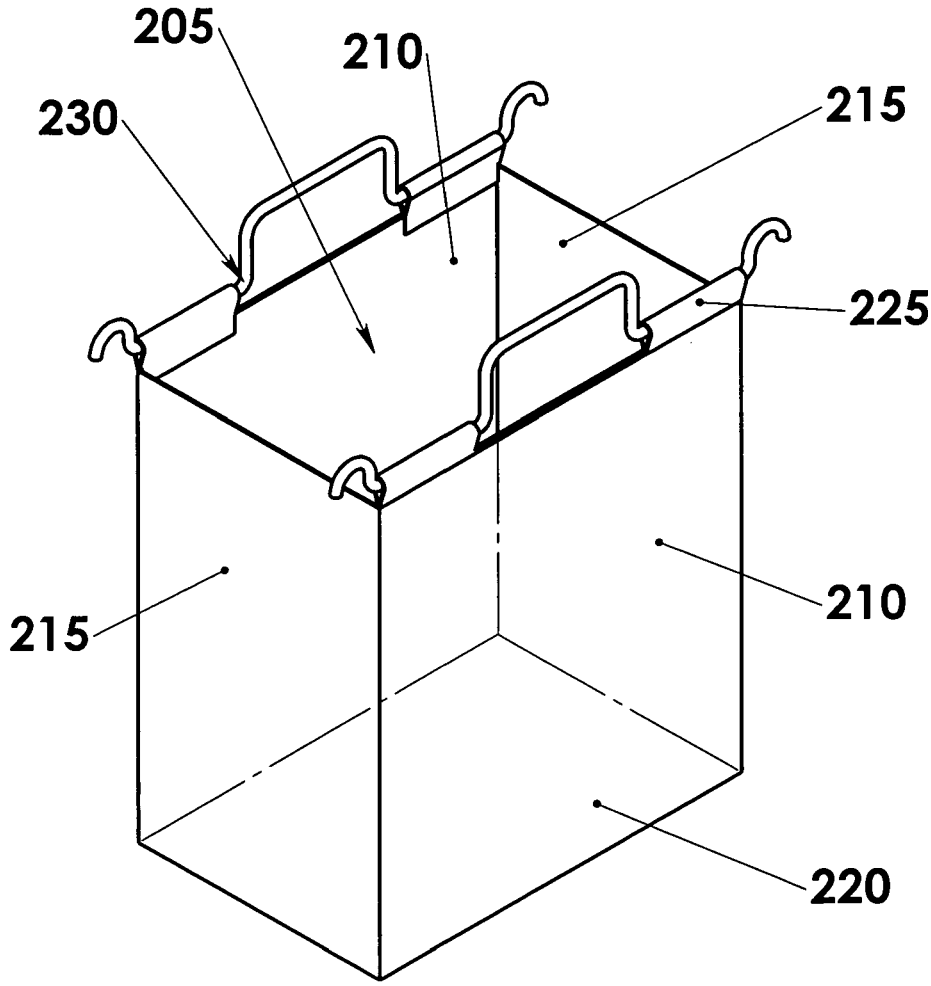
FIG. 4 is a perspective view of a laundry bag assembly.
Figure 5:
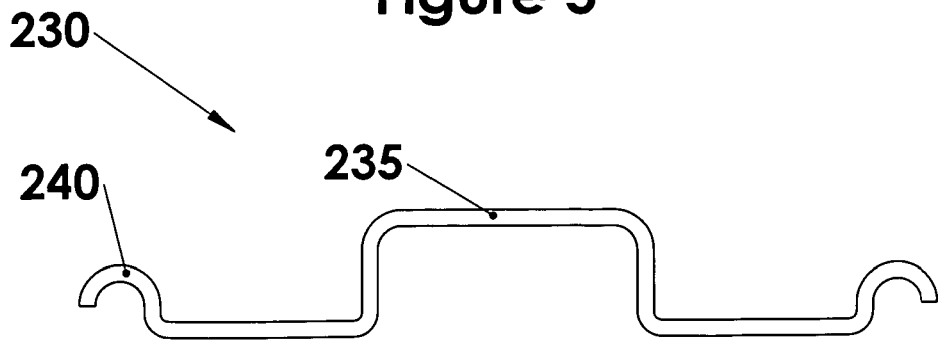
FIG. 5 is a side view of a hanger.

As further illustrated in FIG. 4, each one of the pair of opposite panels 210 is provided with a pair of spaced suspension loops 225, permanently secured, preferably by stitching, adjacent an open top. Each one of the pair spaced suspension loops 225, further called "loops 225", is usually made of flexible material, resistant to relative high tensions, and is adjacent to a proximate upper intersection between one of the pair of opposite panels 210 and an adjacent one of the pair of opposite side panels 215. A loop 225 can also be formed: by using a strap having one end portion firmly secured, adjacent the open top, to each one of the pair of opposite panels 210, and by doubling back and temporarily securing a second end portion to a remainder of the strap. To this end, use is made of removable attachments such as Velcro™, snap fasteners, buttons and buttonholes or alike. Loops 225 can also be made by folding portions of the upper margins of the pair of opposite panels 210 and then stitching to the latter.

As stated in the foregoing description, each laundry bag is provided with a pair of hangers 230. Each one of said pair of hangers 230 has a rod structure with a generally elongated profile, provided with a central grip portion 235, adaptable to accommodate a user's hand. Central grip portion 235 is spaced upwardly from the remainder part of hanger 230; hence it is situated above the latter (remainder part), and does not interfere with loops 225. Central grip portion 235 being vertically oriented, the carrying of the laundry bag 205 can be comfortably accomplished in one hand. Each hanger 230 terminates at each end with a semi-circular configuration 240, so dimensioned as to engage upon and slidably fit on front and back support bars 115 and 120. Semi-circular configurations 240 are open downwardly. Hanger 230 can be easily inserted through loops 225 of each one of the pair of opposite panels 210, so that central grip portion 235 will be situated between loops 225. The removal of a hanger 230 from the loops 225 is, obviously, as easy as the insertion into the loops 225.

A distance between the geometrical centers of semicircular configurations 240 of a hanger 230 is commensurate with a distance between the longitudinal geometrical axes of front and back support bars 115 and 120.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

The invention claimed is:

1. A combination of a telescopically extendable frame with a laundry bag assembly, adaptable to be mounted in closet receptacles of various articles of furniture, comprising a telescopically extendable frame incorporating front and back support bars and a laundry bag assembly including one or more laundry bags placed on and dependent from said front and back support bars, so that said one or more laundry bags are translatable along said front and back support bars, said front and back support bars being so spaced apart as to permit said laundry bag assembly to be located between said front and back support bars and suspended from said front and back support bars; said telescopically extendable frame comprising left and right means for sliding and said front and back support bars, each one of said left and right means for sliding including a pair of rails and a plurality of antifriction rolling elements disposed between them, one of said pair of rails being selected from the group consisting of an external rail and an internal rail is used for securing to an adjacent panel facing an interior of said closet receptacles, while, to the other one of said pair of rails, said front and back support bars is each used for attachment with their extremities, so that said external rail and said internal rail are interchangeable regarding their attachments to said adjacent panel and said front and back support bars;

one of said one or more laundry bags including, when collapsed, a pair of flat overlying panels for forming a pair of opposite panels and a pair of folded panels, generally extendable inwardly between said pair of opposite panels from opposite side edges of the latter, for forming a pair of opposite side panels; each one of said one or more laundry bags, seen when unfolded, having a closed, flat bottom; each one of said pair of opposite panels being provided, close to its top, with a pair of spaced suspension loops, each one of the latter being adjacent to a proximate upper intersection between one of said pair of opposite panels and an adjacent one of said pair of opposite side panels;

said laundry bag assembly including as well a pair of hangers for each one of said one or more laundry bags, each one of said pair of hangers, having a rod structure with a generally elongated profile, being provided with a central grip portion for a user's hand, said central grip portion being spaced upwardly from a remainder part of each one of said pair of hangers and being situated above the remainder part, prevents an interfering with said pair of suspension loops;

each one of said pair of hangers terminating at each end with a semi-circular configuration that is so dimensioned as to slidably fit on said front and back support bars, said semi-circular configurations expanding upwardly from said remainder part of each one of said pair of hangers, so that each one of said pair of hangers is easily insertable through said pair of spaced suspension loops of each one of said pair of opposite panels, so that said central grip portion will be always situated between said pair of spaced suspension loops, while the removal of each one of said pair of hangers from the latter is as easy as the insertion into them.

2. The combination of a telescopically extendable frame with a laundry bag assembly, as defined in claim 1, wherein said front and back support bars are each attached with their extremities to each said internal rail of said left and right means for sliding.

3. The combination of a telescopically extendable frame with a laundry bag assembly, as defined in claims 1 or 2, wherein said front and back support bars are each so attached with their extremities to each said internal rail of said left and right means for sliding, that said front and back support bars can be can be replaced to correspond to different widths of said closet receptacles.

4. The combination of a telescopically extendable frame with a laundry bag assembly, as defined in claim 1, further comprising a pair of elongated bodies, one of said pair of elongated bodies being used for longitudinally locating said left slide and the other one of said pair of elongated bodies being used for longitudinally locating said right slide, each one of said pair of elongated bodies incorporating transversally, almost entirely, either one of said left and right slides, said pair of elongated bodies being perpendicularly traversed by a pair of extremities of said front and back support bars.

* * * * *